United States Patent [19]

Kerr

[11] 4,428,575

[45] Jan. 31, 1984

[54] OPTICAL ILLUSION CHAMBER

[76] Inventor: James S. Kerr, 1117 Wiltshire, San Antonio, Tex. 78209

[21] Appl. No.: 427,795

[22] Filed: Sep. 29, 1982

[51] Int. Cl.[3] ..... A63J 5/00

[52] U.S. Cl. ..... 272/8 R

[58] Field of Search ..... 272/8 R, 8 D; 434/236; 351/239; 40/160

[56] References Cited

PUBLICATIONS

Ittelson, William H., *The Ames Demonstrations in Perception,* Princeton University Press, Princeton, N.J., 1952. p. 45. "Distorted Room Recipe No. 56" Exploratorium, 1975.

*Primary Examiner*—Richard T. Stouffer

*Attorney, Agent, or Firm*—Gunn, Lee & Jackson

[57] ABSTRACT

An optical illusion device consisting of a three section backmember, one end section being larger and having features proportionally larger than features common to the smaller end section and positioned proportionally farther distance from a vertical plane in front of the three section backmember and parallel to the end sections. Each of the end sections has its own level floor on a horizontal plane at right angles to the plumb and is sized to accommodate a person thereon. The floor of the larger end section is on a lower plane than the floor of the smaller end section. Viewers' eyes are positioned along the vertical plane at one or more viewing peepholes. The larger and smaller end sections are adjusted vertically in relation to each other so that sight lines from the peepholes to be common features in the two end sections lie on a plane that is level from the viewers' left to right. An interconnecting center section has dimensions that match the larger end section where they come together, but decreases in size and angles forward to the degree necessary to match the dimensions and come together with the smaller end section. When viewed through the peepholes, the three sections appear to be equidistant from the viewers.

11 Claims, 11 Drawing Figures

OPTICAL ILLUSION CHAMBER

BACKGROUND AND PRIOR ART

This invention relates to optical illusion devices that make use of distorted construction to create a false perspective so that a misshapen object will appear to be of normal shape.

To the best knowledge of this applicant, the closest related device was invented about thirty-five years ago Adelbert Ames, Jr. at the Dartmouth Eye Institute. Ames built distorted rooms that appeared symmetrical when seen from a properly placed peephole. A one time associate of Ames, Professor William Ittelson, built an Ames type of room at the Graduate Center of the City University of New York for use in studying the psychology of visual perception. Ittelson also wrote a book titled "The Ames Demonstrations in Perception, A Guide to Their Construction and Use"; published by the Princeton University Press in 1952. This book contains plans for a variety of the Ames type of room and was the main guide used in the construction of the Distorted Room of San Francisco's Exploratorium. This model of the Ames room is currently a popular exhibit at the Exploratorium and to the best knowledge of this applicant represents the present state of the art for this type of device. Unlike the three section design of this invention, the Ames type of room is nonrectangular from one side to the other. The back wall, floor and ceiling are slanted and taper from the larger wall on one side to the smaller wall on the other side. When seen through the peephole, the room appears to be rectangular because each point of reference in the room lies along the line of sight leading from the peephole to the position the point would occupy in a rectangular room. A person walking across the slanted floor from the larger to the smaller side appears to grow in size. A person on one side of the chamber appears larger than a person of the same size on the other side of the chamber. Only the nonrectangular center section of the three section stage of this invention is related in any way to Ames type of construction design.

SUMMARY OF THE INVENTION

The object of this invention is to provide a stage which, when viewed through a peephole, appears to be symmetrical and level. However, a person or object in one end section will appear to be smaller by a definite ratio or percent than a person or object of the same size on the other end section. The difference in size of the two objects would be constant regardless of where the object is moved in its particular end section. The three section stage of the present invention accomplishes this by limiting the nonrectangular construction that creates the false perspective to the center section. The two end sections although of different size may be rectangular with level floors and ceiling (if included).

The advantages of the present three section stage in which the nonrectangular area is limited to the center section are as follows:

(1) Where the entire illusion area is nonrectangular the apparent size of subjects on stage continuously change as they move about giving an unrealistic effect and tending to betray the illusion. With the three section stage of this invention, the apparent size of the subjects remains fixed as they move about in the two end sections.

(2) With the proposed three section stage, there is a definite mathematical ratio for the dimensions of the larger and smaller end sections. With such a predetermined mathematical relationship, size establishing cues may be provided by having what are normally standard size objects, such as doors, tools, newspapers, etc. made to the same scale as the larger and smaller end sections and located in their respective sections. Such cues establish a fixed reference as to how large or small a person appears to be in relation to his actual size. In the Ames type room, such size establishing cues are not possible because there is no fixed ratio to tie the objects to and although the viewer can see that objects seem to be changing size, the viewer has no indication as to real size relationships. Studies in perspection psychology with the Ames type of room show that the illusion is weakened by the viewer's tendency to see a familiar figure (such as a child familiarity with his parent's size) as being close to the size they know him to be. The size establishing cues possible with this invention reenforce the illusion and make it believeable and dramatic.

(3) With the Ames type of illusion chamber, the entire floor is inclined. Walking on the floor by a subject is difficult and the awkward foot to leg angle that results indicates to the viewer that the floor is not level. With the proposed three section stage, the floor is inclined only in the center section. The level floors of the two end sections, where subjects may spend most of their time, make it easy and natural looking for subjects to enter, move about, and exit.

(4) With the proposed three section stage, subjects dramatically change from one established size to another during the brief period when they cross the nonrectangular center section as they change sides. The effect is more startling than seeing subjects continuously changing size as they move about in the Ames type of room.

(5) With the three section stage, it is possible to add a low vertical screen that would conceal the subject's feet from the viewer during the brief period when he steps across the slanted floor of the center section. With such a screen, the viewer would not detect the telltale foot to leg angle problems that indicate that the floor is not level. The screen could take the form of a low table, a stand, a sign, etc. so that its real purpose would not be obvious. Where the entire floor is slanted, such a screen would not be effective.

The present invention has entertainment value and will be useful in expanding the studies of perceptual psychology that have been done with the Ames room.

DESCRIPTION OF THE PREFERRED EMBODIMENT

Figure 1:
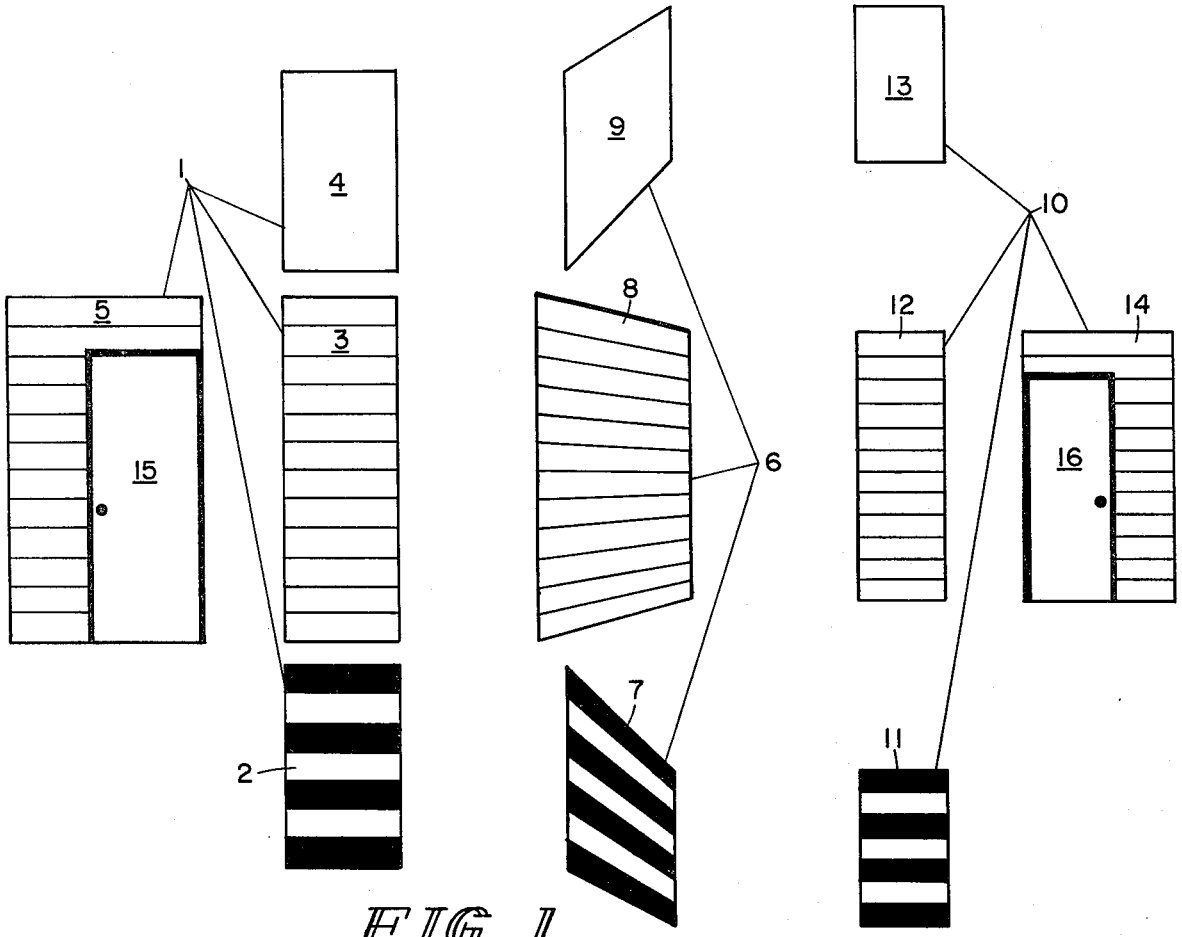
FIG. 1 is an exploded view of components of three sections that form a stage for this invention.

The components for a three section stage to be used in a preferred embodiment are shown in the exploded view of FIG. 1. The larger end section 1 consists of a floor 2, backwall 3, ceiling 4, and side wall 5. The center section 6 consists of a floor 7, backwall 8, and ceiling 9. The small end section 10 consists of a floor 11, backwall 12, ceiling 13, and side wall 14.

In the preferred embodiment, the larger end section 1 is proportionally larger than the smaller end section 10 by the ratio of 9:7. In this typical example, nine feet is the height of the larger end section, including the backwall 3 and the side wall 5; seven feet is the height of the smaller end section 10, including the back wall 12 and side wall 14. The dimensions of the larger end section floor 2 and ceiling 4 are approximately 36 inches wide by 63 inches deep. The dimensions of the smaller section floor 11 and ceiling 13 are approximately 28 inches wide by 49 inches deep. The larger end section door 15 is 90 inches high. The smaller end section door 16 is 70 inches high. All the dimensions of the larger end section 1 are proportional to the dimensions of the smaller end section 10 by the same 9:7 ratio. Other dimensions and another ratio could be used. For example, the height of the large end section 1 may be proportional to the height of the smaller end section 10, but the width of the end sections may not be so proportioned, and still provide the illusion.

The center section 6 is designed to interconnect the two end sections 1 and 10. The left side of the center section 6 (as viewed in FIG. 1) matches the dimensions of the larger end section 1. The right side of the center section 6 matches the dimensions of the smaller end section 10. The center section back wall 8 is tapered so that it measures 9 feet high on the left side and 7 feet high on the right side. The center section floor 7 and ceiling 9 are 63 inches deep on the left side and 49 inches deep on the right side. The width of the center section floor 7 and ceiling 9 as shown in FIG. 1 is 32 inches. The center section floor 7 and ceiling 9 are made tapered and diagonal. The floor stripes and wall lines of the two end sections 1 and 10 have the same 9:7 ratio for spacing therebetween. The lines and stripes of the center section 6 are tapered so they match the respective lines and stripes of each end section 1 and 10 when connected. The components of the two end sections 1 and 10 are rectangular. The tapered and diagonal components are limited to the center section 6.

Figure 2:
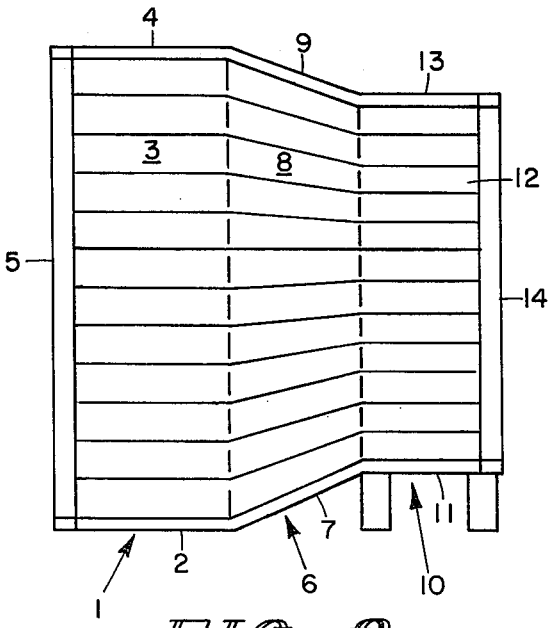
FIG. 2 is an orthographic projection showing a frontal view of the three sections assembled shown in FIG. 1 joined together to form an illusion stage.

FIG. 2 is a frontal elevated view of the three sections 1, 6 and 10 assembled and joined together to form an 8 foot wide stage; however, in some situations, the sections may only be juxtaposed without physical joinder. The respective widths of the three sections 1, 6 and 10 are 36 inches, 32 inches, and 28 inches. The center section back wall 8, floor 7, and ceiling 9 make flush junctions with the two end sections' back walls 5 and 12, floors 2 and 11, and ceilings 4 and 13.

Figure 3:
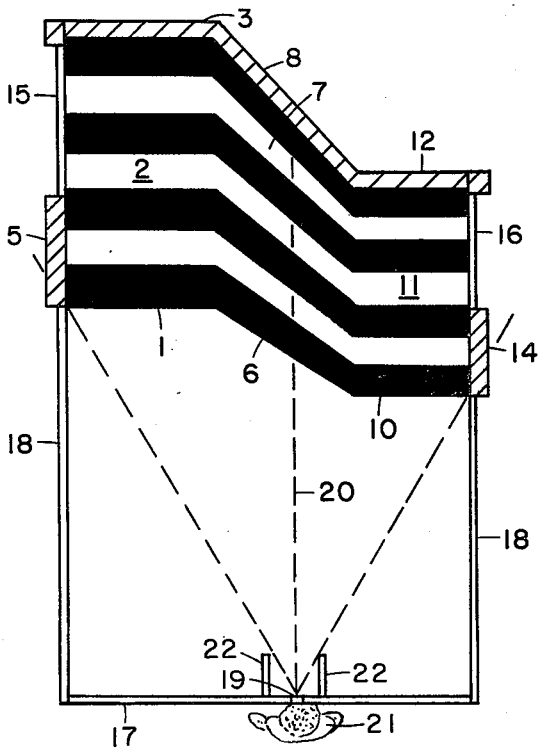
FIG. 3 is a top view of the assembled stage with ceilings removed, and a peephole wall with screening side walls that form the illusion chamber.

FIG. 3 shows a top view of the illusion chamber showing the assembled stage (ceiling cut away) and with a peephole wall 17 and screening walls 18. A peephole 19 to view the stage is located in a peephole wall 17. The peephole wall 17 is set in a vertical plane in front of the three sections 1, 6 and 10, and is parallel to the back walls 3 and 12 of the two end sections 1 and 10. In the preferred embodiment, the peephole wall 17 is as wide as the stage. The respective distances of the larger end section 1 and the smaller end section 10 from the vertical plane of peephole wall 17 have the same 9:7 ratio as does the dimensions of the larger and smaller end sections 1 and 10. In this typical example, the perpendicular distance from the peephole wall 17 is (1) 153 inches to the larger end section back wall 3, and (2) 119 inches to the smaller end section back wall 12, which is the same 9:7 ratio.

In this embodiment, the peephole 19 is also located on a vertical plane 20 (represented by the dotted line) that is perpendicular to the peephole wall 17 and divides the center section 6 into two parts that have the same 9:7 ratio as the end sections 1 and 10. This plane 20 is the optical center of the illusion stage.

Side walls 18 connect the ends of the peephole wall 17 to the side walls 5 and 14 of the two end sections 1 and 10, respectively, so that the peephole 19 is the only way to view the stage.

The peephole 19 is sized so that only one eye can be used by the peephole viewer 21. The stereoscopic effect of two eye vision weakens the illusion. Vision restrictors 22 are vertical panels extending forward on each side of the peephole 19 to cut off from view of the peephole viewer 21 the front edges of the side walls 5 and 14 of the two end sections 1 and 10, respectively. (See FIG. 3.) Vision restrictors 23 are horizontal panels extending forward both above and below the peephole 19 to cut off from view of the peephole viewer 21 the front edges of the floors 2, 7 and 11, ceilings 4, 9 and 13 of the three sections 1, 6 and 10, respectively. In this embodiment, the view from the peephole 19 must be limited to the three sections 1, 6 and 10 of the stage to obtain the true effect of the illusion.

Figure 4:
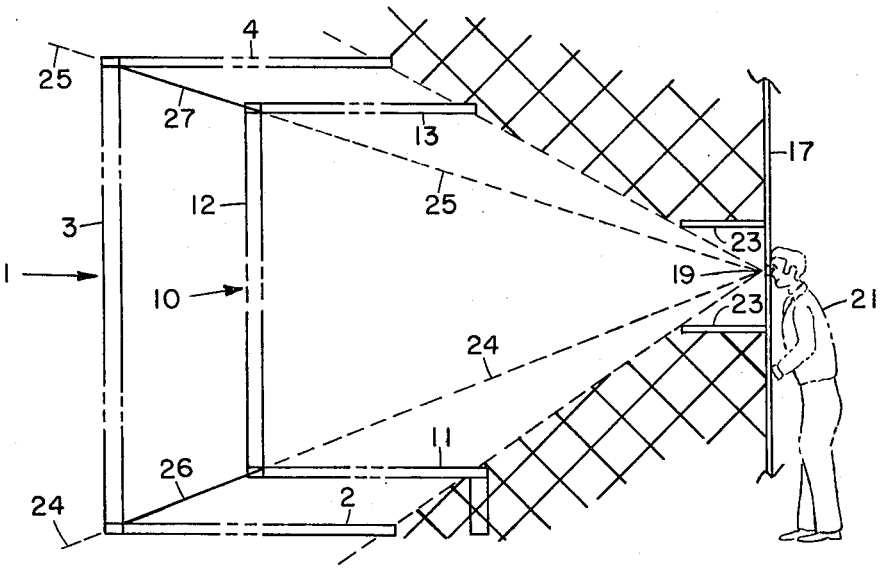
FIG. 4 is an orthographic projection giving a side view of the floors, back walls and ceiling of the two end sections that shows their vertical position in relation to the peephole. For clarity, the distorted center section is omitted except for a line that represents the back edge of its floor and a line that represents the back edge of its ceiling.
Figure 5:
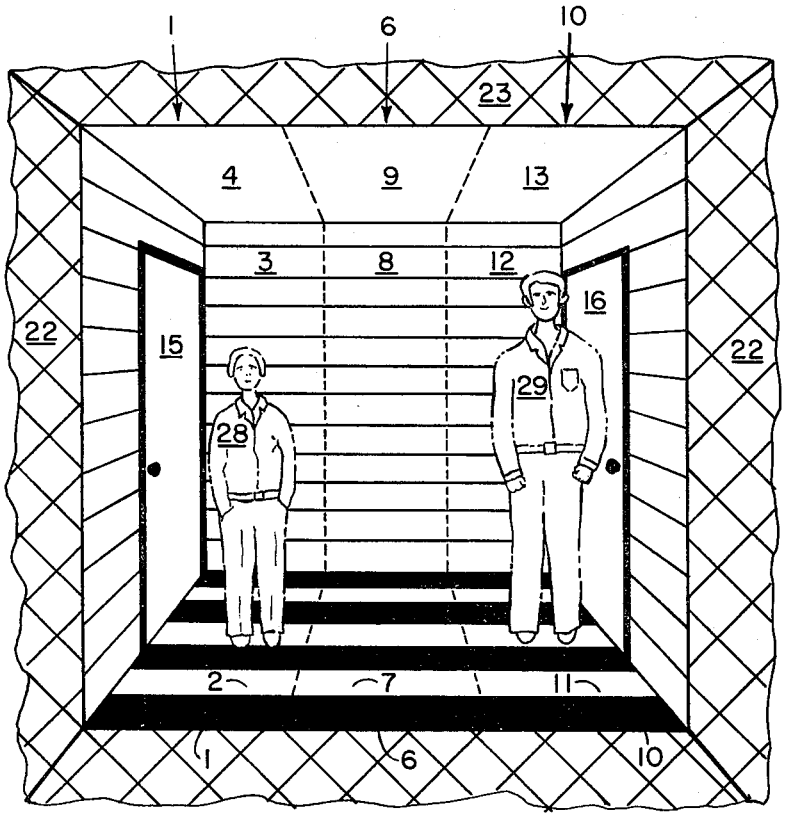
FIG. 5 is a pictorial view of the illusion stage shown in FIG. 3 as seen through the peephole.

FIG. 4 shows the two end sections 1 and 10 adjusted vertically in relation to each other so that sight lines from the peephole 19 to common points of reference on the two end sections 1 and 10 will appear to fall on a plane 24 that is level from left to right. This adjustment is possible because the relative sizes of the two end sections 1 and 10 are proportional to their distance from the peephole wall 17. Peephole sight lines to the back edges 36 and 37 of the floors 2 and 11 lie on a plane 24 represented by the broken line. Peephole sight lines to the back edges of the ceilings 4 and 13 lie on a plane 25 represented by the broken line. The back edge of the slanting center section floor 7 that interconnects the back edges of floor 2 and 11 is represented by the line 26. As shown in FIG. 4, all points on this line 26 lie on the plane 24. Peephole sight lines to the back edges of all three floors 2, 7 and 11 lie on the plane 24. The back edge of the center section slanting ceiling 9 is represented by the line 27. All points on this line 27 lie on plane 25. Peephole sight lines to the back edges of all three ceilings 4, 9 and 13 lie on the plane 25. To the peephole viewer 21, the back edges of the three floors 2, 7 and 11 as common points of reference will appear to be one level line from left to right and the back edges of the three ceilings 4, 9 and 13 as other common points of reference will appear to be one level line. The peephole viewer is led to assume that the center section 6 is square and level and the two end sections 1 and 10 are of equal size and equidistant from the peephole wall 17. As shown in FIG. 5, a pictorial view of the illusion stage as seen through the peephole 19, the three sections 1, 6 and 10 appear to form one level and uniform stage.

A person 28 in the large end section 1 will appear to be smaller than another person 29 of the same size in the smaller end section 10 to the same degree that end section 1 is larger than end section 6. This relationship is fixed regardless of where the subjects stand in their particular end section 1 or 10.

If there were no reference cues to indicate size, a viewer may assume the person 28 in the larger section 1 is normal size and the person 29 in the smaller section 10 is a giant, or perhaps the person 29 in smaller section 10 is normal size and the person 28 in the larger section 1 is a midget.

In the preferred embodiment, the doors 15 and 16 serve as size establishing cues. Most regular doors are 80 inches high. Since the larger end section door 15, which is actually 90 inches high and 36 inches wide, and the smaller end section door 16, which is actually 70 inches high and 28 inches wide, appear to be the same size, the viewer 21 tends to assume that both doors 15 and 16 are regular 80 inches high and 32 inches wide doors. If the doors are assumed by the viewer to be normal 80 inch doors, the apparent dimensions of the stage would be about 8 feet high and 8 feet wide. The 90 inch door 15 is 12.5% taller and the 70 inch door 16 is 12.5% shorter than a regular 80 inch door. A 5 foot 8 inch person in the larger end section 10 would appear to be 12.5% shorter or less than 5 feet tall, and in the smaller end section, he would appear 12.5% taller or 6 feet 4 inches tall. Additional size establishing cues consisting of usually standard sized objects, such as base plugs, telephones, tools, newspapers, etc., but made 12.5% larger or 12.5% smaller than regular size and placed in their respective end sections 1 and 10, would help establish the apparent size of the stage and subjects upon it and strengthen the illusion. Such clues are not possible in the Ames type of room because there is no fixed ratio to which to tie the subjects.

FIG. 5 also illustrates the effect of the vision restrictors 22 and 23 placed around the peephole 19.

Figure 6:
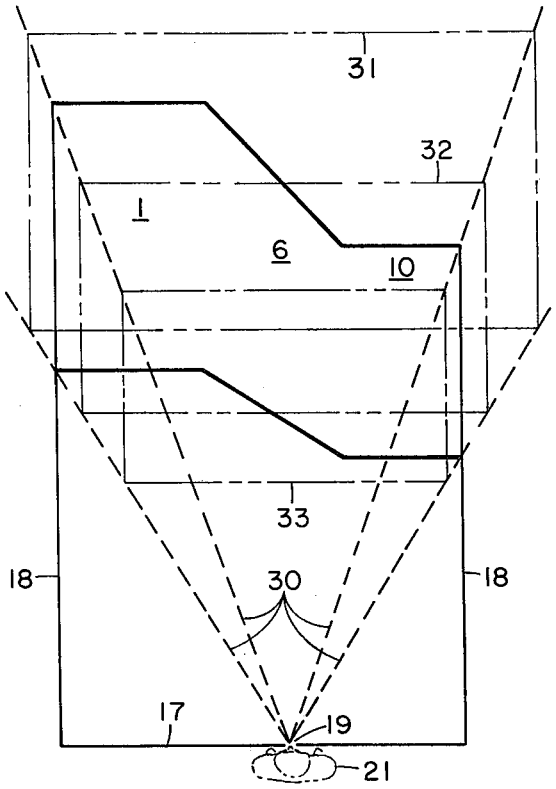
FIG. 6 is a top view pictorial diagram illustrating the apparent floor plan of the stage as shown in FIG. 3 indefinite in size without the presence of size establishing cues.

FIG. 6 is a top view pictorial diagram illustrating the size of the apparent stage could vary in the mind of the viewer 21 if size establishing cues are absent. Sight lines from the peephole 19 to the outside corners of the two end sections 1 and 10 lie on vertical planes 30 represented by the broken lines. The four corners of the apparent stage could lie anywhere along these vertical planes 30. The broken line rectangles 31, 32 and 33 show possible typical sizes of the floor plan of the apparent stage. Without the size establishing cues described above, the viewer 21 would have no reference to define the apparent size of the stage. He could see that subjects change size, but would have no indication as to relative size.

Figure 7:
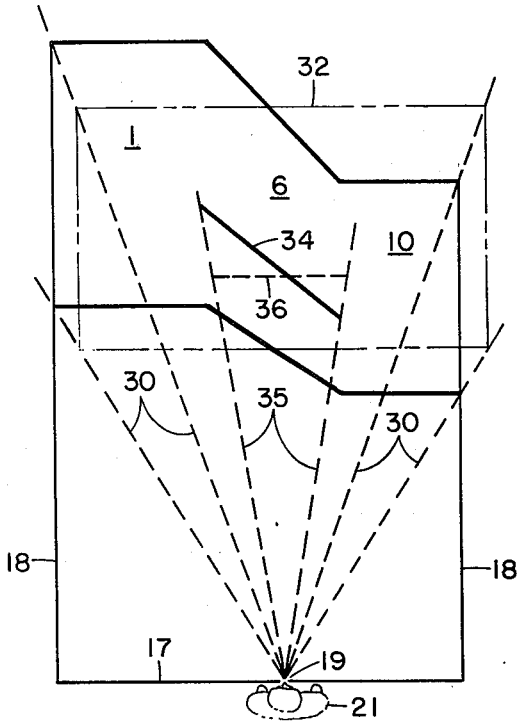
FIG. 7 is a top view pictorial diagram of another embodiment in which a screen is placed across the center section.

FIG. 7 is a top view pictorial diagram of an embodiment in which a low vertical screen is placed across the center section 6 to conceal the feet of subjects crossing its slanted floor 7. This screen 34 is tapered and set diagonally so that it interconnects common points of reference on the two end sections 1 and 10. The 18 inch height of the screen 34, i.e. its taller side which joins the larger end section 1, has a 9:7 ratio to the 14 inch height of screen 34, i.e. its shorter side which joins the smaller end section 10. The distances to the peephole wall 17 of the taller and shorter sides of screen 34 also have a 9:7 ratio. Peephole sight lines to the right and left sides of screen 34 lie on vertical planes 35 represented by the dash lines. When seen through the peephole 17, the screen 34 will appear to be positioned as shown by the broken line representation 36 with the apparent floor plan of the stage being represented by the broken line rectangle 32.

Figure 8:
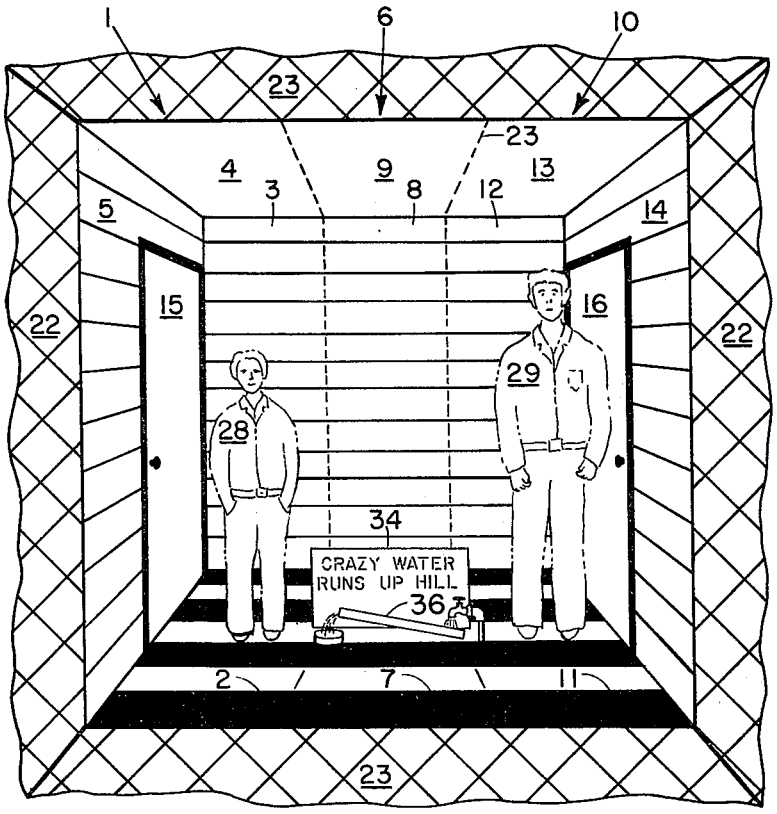
FIG. 8 is a pictorial view of the illusion stage as shown in FIG. 7 as seen by the peephole viewer.

As shown in FIG. 8, upon being viewed through the peephole 19, the screen 34 will appear to be rectangular and parallel to the back walls 3 and 12 of the two end sections 1 and 10, respectively. The screen 34 in this embodiment is in the form of a sign so the real purpose of the screen 34 (to conceal the awkward foot to leg angle) would not be obvious.

FIG. 8 also shows another optical illusion 36 that is set against the bottom of the screen 34. In this embodiment, water appears to run uphill because although the screen 34 looks level, it actually slopes down toward the larger end section 1. The water trough 36, in front of the screen 34, also slopes down toward the larger end section 1, but to a lesser degree, so (to the peephole viewer 21) it appears to be sloping up. Both the trough and the printed letters of the sign must be of the correct nonrectangular design in order to appear symmetrical and rectangular to the peephole viewer 21.

In another embodiment, not shown, the screen could take the form of a low stand or table which could hold normal appearing objects, such as rectangular boxes. The stand and the boxes upon it would have to match the nonrectangular construction of the center section 9 so that they would appear to be symmetrical and rectangular. If one of the boxes were picked up and turned over, to the peephole viewer 21, it would appear to spring out of shape creating yet another illusion.

Figure 9:
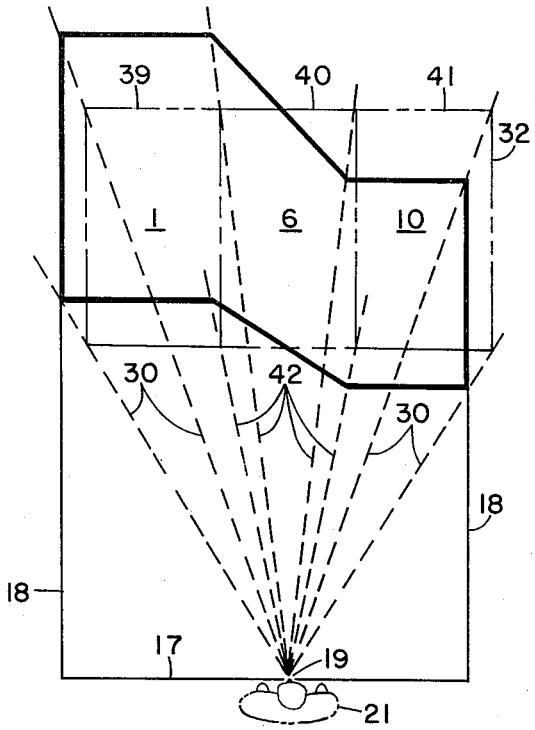
FIGS. 9, 10 and 11 are top view pictorial diagrams illustrating the effect of shifting the peephole laterally on the peephole wall.
Figure 10:
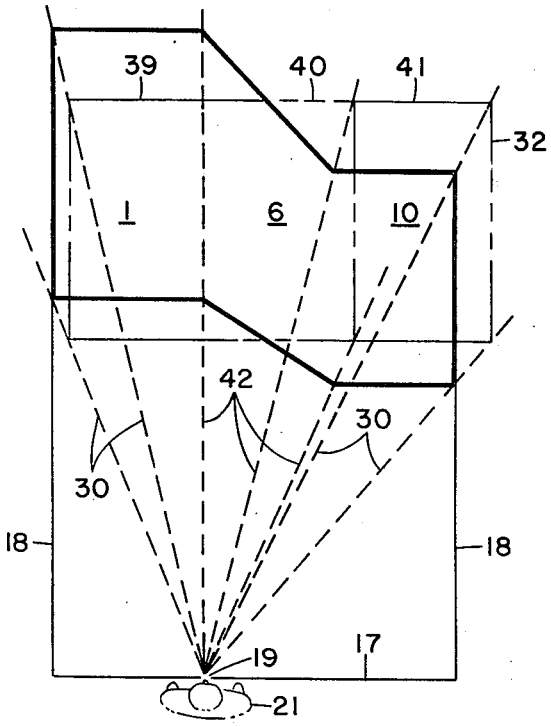
Figure 11:
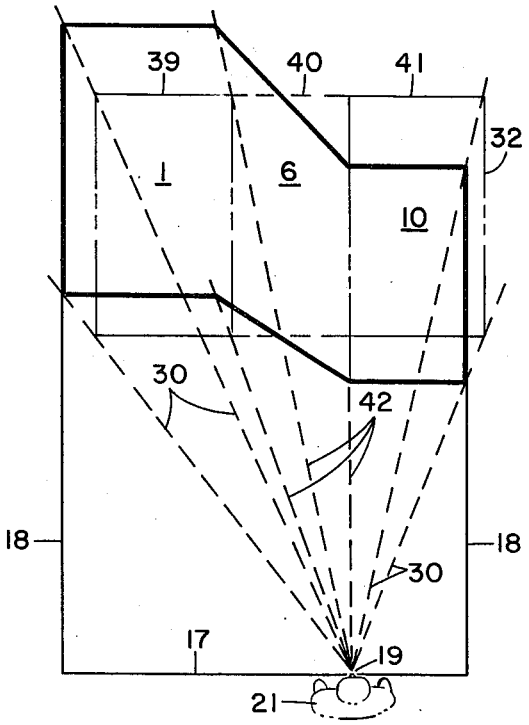

FIGS. 9, 10 and 11 demonstrate that for the other embodiments, the peephole 19 can be moved laterally across the peephole wall 17 and the illusion will still be effective. In the preferred embodiment, the peephole 19 was placed at the optical center position as shown in FIG. 9, and the apparent size of the three sections 1, 6 and 10 being represented by the broken line rectangles 39, 40 and 41, respectively, appear to be equal. FIG. 10 shows a slightly different embodiment in which the peephole 19 is shifted to the left of the optical center. The size of the apparent end sections 39 and 41 are unchanged, but the apparent center section 40 is now wider. FIG. 11 shows the peephole 19 moved to the right. The size of the apparent end sections 39 and 41 remain unchanged, but the apparent center section 40 is now narrower. The main effect of moving the peephole 19 laterally is on the width of the apparent center section 40. The dimensions of the apparent end sections 39 and 41, where the subjects usually are, remain unchanged. In another embodiment, not shown, several peepholes could be used simultaneously and the illusion would be effective for all. With the Ames type of room, the entire room apparently narrows or widens as the peephole is shifted laterally.

As another possible embodiment (not shown), no ceiling is necessary if the vision restrictors 23 properly block the uppermost view of the peephole viewer. Likewise, no side walls are necessary if the vision restrictors 22 properly block the side views of the peephole viewer 21.

As another possible embodiment (not shown), the three sections 1, 6 and 10 that form the stage could be lengthened to extend up to or near the peephole wall 17. Thus, the vision restrictors 22 and 23 would not be required. In the preferred embodiment, the stage was not so extended in order to reduce the size of the invention making it more easily placed on a trailer for movement to different locations.

While the invention has been described in connection with the preferred embodiment, it is not intended to limit the invention to the particular forms set forth; but on the contrary, it is intended to cover alternatives, modifications, and equivalents as may be included within the spirit and scope of the invention as defined by the appended claims.

What is claimed is:

1. An optical illusion device consisting of two regularly constructed end sections having a predetermined size differential, each of said end sections having its own level floor being on a horizontal plane at right angles to the plumb and sized to accomodate a person thereon, said end sections being connected by a distorted center section, a peephole located forward of said two regularly constructed end sections, a viewing of said optical illusion device from said peephole producing a false perspective that said two regularly constructed end sections appear to be of equal size.

2. The optical illusion device as defined in claim 1 including a screen placed across said distorted center section and interconnecting common points of reference on said end sections.

3. The optical illusion device as defined in claim 1 wherein said end sections and said distorted center section have ceilings connected to rear walls, said end sections having side walls on opposing ends thereof.

4. The optical illusion device as defined in claim 3 having vision restriction means adjacent to said peephole, said vision restriction means extending inward toward said end sections and said distorted center section.

5. An optical illusion device consisting of a three section backmember, one end section being larger and having features proportionally larger than features common to a smaller end section and positioned proportionally farther distance from a vertical plane in front of said three section backmember, each of said end sections having its own level floor being on a horizontal plane at right angles to the plumb and sized to accomodate a person thereon and further having a rear wall, said rear wall being parallel to said vertical plane, said floor of said larger end section being on a lower plane than said floor of said smaller end section, said vertical plane being the approximate position of the eyes of viewers viewing said backmember through provided peephole members, said end sections being adjusted vertically in relation to each other so that sight lines from said eyes to common points of reference on said larger and smaller end sections will lie on a plane that is level from said viewers' left to right, a center section juxtaposed at a first side to said larger end section and matching first dimension of said larger end section and distorted to an extent of gradually diminishing in size and angling forward to a degree necessary such that a second side is juxtaposed to said smaller end section and matches second dimensions of said smaller section thereby creating a false perspective when viewed through said peephole member that said end sections appear to be equidistant from said viewers.

6. The optical illusion device as defined in claim 5 including a screen member placed across said center section of said three section backmember, said screen visually interconnecting common points of reference of said larger and smaller end sections, said screen being tapered so that the height of a larger side of said screen is to the height of a smaller side of said screen by proportion as said distance of said larger end section from said vertical plane is to said distance of said smaller end section from said vertical plane.

7. The optical illusion device as defined in claim 5 including vertical and horizontal vision restriction means to prevent observation by said viewer beyond predetermined bounds of said three section backmember, said vision restriction means extending inwardly from said peephole member toward said three section backmember.

8. The optical illusion device as defined in claim 7 wherein both said end sections and said center section have ceilings; said smaller end section having a forwardly extending wall and said larger end section having a forwardly extending wall to appear as a stage when viewed from said peephole members.

9. An optical illusion device comprising a viewing peephole in front of a three section stage, a first end section of said stage being larger than a second end section of said stage and located farther from said peephole than said second end section of said stage, each of said end sections having its own level floor being on a horizontal plane at right angles to the plumb and sized to accomodate a person thereon, said first end section and said second end section being vertically adjusted in relation to each other so that sight lines from said peephole to common points of reference on said first and second end sections lie in a plane that is level from a viewer's left to right, an interconnecting center section having uniformly tapered dimensions to match said first and second end sections at points of joinder thereto so that said first and second end sections and said interconnecting center section appear as a uniform stage when viewed from said peephole.

10. The optical illusion device as defined in claim 9 having vision restriction means extending from said wall adjacent to said peephole toward said stage to prevent observation of more than a predetermined portion of said stage when viewed from said peephole.

11. The optical illusion device defined in claim 9 wherein both end sections of said stage and said center section have ceiling and rear walls, both of said end sections of said stage having a forwardly extending wall on opposing ends thereof.

* * * * *